United States Patent [19]

Chaikin

[11] 3,979,211

[45] Sept. 7, 1976

[54] VESICULAR IMAGE TRANSFER PROCESS

[75] Inventor: Saul W. Chaikin, Menlo Park, Calif.

[73] Assignee: Xidex Corporation, Sunnyvale, Calif.

[22] Filed: Feb. 11, 1974

[21] Appl. No.: 441,094

[52] U.S. Cl. ..... 96/29 R; 96/48 R; 96/48 HD; 96/49.75

[51] Int. Cl.[2] ..... G03C 5/54; G03C 5/18; G03C 5/34

[58] Field of Search ..... 96/29 R, 48 R, 48 HD, 96/49.35, 27 R, 46

[56] References Cited

UNITED STATES PATENTS

| | | | |
|---|---|---|---|
| 2,911,299 | 11/1959 | Baril et al. | 96/49 |
| 3,032,414 | 5/1962 | James et al. | 96/49 X |
| 3,093,478 | 6/1963 | Peterson et al. | 96/35 |
| 3,158,480 | 11/1964 | Adkisson et al. | 96/48 HD |
| 3,223,526 | 12/1965 | Grieshaber et al. | 96/46 |
| 3,316,088 | 4/1967 | Schaffert | 96/48 R X |
| 3,466,172 | 9/1969 | Skarvinko | 96/49 |
| 3,513,010 | 5/1970 | Notley | 96/27 R X |
| 3,536,490 | 10/1970 | Hochberg | 96/27 R X |
| 3,615,475 | 10/1971 | Skarvinko | 96/27 R X |
| 3,622,333 | 11/1971 | Cope | 96/49 X |

OTHER PUBLICATIONS

Jaskowsky, Def. Pub. Search Copy of Ser. No. 26,703, filed 4/8/1970, published in 880 OG 1163 on 11/24/1970, Def. Pub. No. T880,011.

*Primary Examiner*—Charles L. Bowers, Jr.
*Attorney, Agent, or Firm*—Townsend and Townsend

[57] ABSTRACT

Method and media for producing a vesicular image suitable for use in the recordation of microform information on an add-on basis. A vesicular film (imaging film) is exposed to actinic radiation to form a latent nitrogen gas image therein. The exposed vesicular imaging film, while still containing the latent image is contacted with a sensitizer-free vesicular film vehicle (receiving film). Sufficient heat and pressure are applied to cause an image-forming amount of nitrogen gas to be transferred from the imaging film to the receiving film. Conditions are selected so that vesiculation does not occur in either the imaging or receiving film up to and including the time of gas transfer. Thereafter, the receiving film is subjected to sufficient heat to develop a vesicular image from the transferred gas.

10 Claims, No Drawings

VESICULAR IMAGE TRANSFER PROCESS

This invention relates to vesicular photography. More particularly, it relates to a system and media for producing a vesicular image in a sensitizer-free vesicular film vehicle (at times referred to as "receiving film") that has been transferred from a vesicular film (at times referred to as "imaging film"), the vesicular film having been initially exposed to actinic radiation to form a latent nitrogen gas image therein from a preselected master image.

The invention provides a system which permits later addition of further imagery to unimaged space on the receiving film. For example, the present invention permits recordation of microform information on an add-on basis. Thus one can generate a microfiche by imaging several frames of information such as letters from a file. Later on, using the same microfiche in the normal way additional imagery can be added to the same microfiche.

The microfiche or receiving film comprises a sensitizer-free vesicular film vehicle. Because of the absence of sensitizer no special protection from light is needed during normal use of the microfiche in order to preserve its receptivity to additional information. Aside from the absence of the sensitizer the receiving film is similar to an ordinary vesicular film and therefore can be handled as an ordinary vesicular film and requires no other special handling.

The present invention is an improvement on the existing method of providing add-on capability for vesicular film. The existing prior art method consists of imaging information on photosensitize vesicular microfilm and locally thermally developing the imaged area. Since the vesicular microfilm contains the usual diazo sensitizer, the unimaged area must be protected with an actinically opaque jacket. Thus the film may be used in normal room light only with its protective jacket. At such time as it is desired to add additional imagery to the microfiche it is necessary to remove the protective jacket in a safe light environment and image onto an unused sensitive area of the film. After local development the remaining unused sensitive areas must be again protected by the actinically opaque jacket before bringing the microfiche into normal working light conditions.

In the present method a conventional vesicular film may be selected as the imaging film. In the preferred embodiment the imaging film differs from conventional vesicular film in that the amount of sensitizer may be higher than that normally employed in vesicular film in an amount that provides satisfactory image sharpness in the receiving film. In addition, the preferred imaging vesicular film is not nucleated. Nucleation is a term employed generically herein to include all of those known techniques by which the physical or chemical microstructure of the vesicular vehicle is altered to promote the formation of visible vesicles during thermal development whereby the final vesicular image is formed in the film. Examples of nucleation techniques are subjecting vesicular film to an aqueous medium at elevated temperatures, as described in U.S. Pat. No. 3,149,971. The incorporation of waxes in vesicular film is described in U.S. Pat. No. 3,355,295. The incorporation of surfactants in vesicular film is described in U.S. Pat. Nos. 3,779,768 and 3,779,774 and immersion in an alkanol having up to 3 carbon atoms is described in copending patent application Ser. No. 346,202, filed Mar. 29, 1973, now U.S. Pat. No. 3,841,874.

It will be appreciated that upon imaging only a latent nitrogen gas image is sought in the vesicular film. Conditions are selected so that vesiculation does not occur in the imaging film. Instead the latent image-forming nitrogen gas molecules are transferred to the receiving sensitizer-free vesicular vehicle. By omitting the nucleation treatment of the imaging film, vesicle formation therein prior to and during the nitrogen gas transfer is inhibited.

Apart from the possible increase in amount of sensitizer and the omission of a nucleation treatment the imaging or vesicular film is similar to conventional vesicular film. Any vehicle suitable for use as a vesicular film vehicle may be employed including the older water soluble vehicles such as gelatin. Preferably the vehicle is of the type more recently used in vesicular film and is formed from a water insoluble thermoplastic synthetic, organic polymer.

The receiving film comprises a vesicular film vehicle which may be suitably coated upon a substrate such as polyethylene terephthalate. Any suitable vesicular film vehicle having a nitrogen permeability in the range useful in vesicular photography may be employed including the older water soluble materials or the newer preferred water insoluble thermoplastic synthetic, organic polymers. Preferred vehicles for both the imaging and receiving films are described in U.S. Pat. No. 3,622,333. The receiving film is free from sensitizer and thereby primarily differs from the imaging film. In the preferred embodiment, the receiving film is nucleated to promote vesicle formation therein upon internally receiving a latent nitrogen gas image and heat development. The nucleation referred to here is the same as that discussed above in connection with the desirability of utilizing an imaging film that is non-nucleated.

In executing the present process the imaging film which contains a photosensitive layer which may comprise a diazonium salt uniformly dispersed in the vehicle is illuminated by an actinic light source suitable for decomposing the diazonium salt sensitizer. Imaging of the imaging film is conventional and may be by contact printing with a master or by projection printing, particularly where a reduction in size is desired. The exposure to light rich in ultraviolet, for example, produces a latent nitrogen gas image in the imaging film. The life of this latent gas image is on the order of minutes depending upon the particular vehicle utilized. The process contemplates prompt contact of the imaging film containing the latent image with the receiving film.

The latent gas image is preferably transferred by application of sufficient heat and uniform pressure. Uniform pressure is desirable so that a uniform contact between the imaging and receiving film is obtained thereby assuring a uniform transfer of the latent image free from bubbles or defects resulting from an inadequate transfer in certain regions. Heat is suitably applied in an amount below that which causes vesiculation and below that which causes excessive lateral diffusion of the latent nitrogen gas within the imaging or receiving film. Lateral diffusion results in reduced sharpness of the image. On the other hand, increased temperature increases the rate of nitrogen transfer from the imaging to the receiving film and therefore it is desirable to use as high a temperature as possible short of that which causes vesiculation or excessive lateral diffusion. The permitted maximum temperature will vary depending upon the nature of the vehicles employed, many of the other variables discussed herein, and the requirements of the user of the system.

After a sufficient time the imaging and receiving films are separated and the receiving film locally thermally developed as with conventional vesicular film producing a vesicular image in the receiving film. The receiving film may now be used in the normal way in which processed vesicular microfilm is used.

In the usual situation the receiving film vehicle is relatively large compared to the images initially placed therein. Thereafter, when it is desired to add additional information to the film the microimagery desired is first produced on imaging film as described above and then transferred by the contact under heat and pressure technique noted above to any vacant area on the receiving vesicular film vehicle. The newly transferred information is then locally thermally developed forming a new vesicular image along with the vesicular images previously developed.

There are a number of factors which will influence the quality of the vesicular image produced on the receiving film. One of the factors is the relative nitrogen permeability of both the imaging and receiving film. While the process is applicable generally to the use of any vesicular vehicle for each of the imaging and receiving films, it is preferable to utilize a vesicular imaging film vehicle of lower nitrogen permeability than the nitrogen permeability of the receiving vesicular film vehicle.

The following examples will more specifically illustrate the invention. In all cases except where noted otherwise, the imaging film after exposure is plied with the receiving film with the vehicles facing each other. The plied sample is placed on a flat block and pressure is applied by a flat silicone pad having a surface larger than the sample. Heat is introduced from a source within the block. Except where noted otherwise, the force applied to the sample is 38 pounds (67.5 psi).

EXAMPLE I

Preparation of Imaging Film

The following ingredients were combined in a beaker and stirred until a clear solution was obtained.

- 79 grams of a 19% solids solution in methyl cellosolve of a polymer of diglycidyl ether of resorcinol with 4,4'-dihydroxydiphenyl sulfone of the type described in U.S. Pat. No. 3,622,333.
- 0.6 grams p-(2,5-diethoxymorpholino) benzene diazonium fluoroborate.
- 0.1 gram of the leveling agent Union Carbide silicone L5202.

The mixture was coated onto a sheet of polyester film using a Bird applicator yielding a dry thickness of 250 microinches after drying in an oven at 105° C. for 3 minutes.

Preparation of Receiving Film

The following ingredients were combined in a beaker and stirred until a clear solution was obtained.

- 105 grams of a 19% solids solution in methyl cellosolve of a polymer of diglycidyl ether of resorcinol with 4,4'-dihydroxydiphenyl sulfone of the type described in U.S. Pat. No. 3,622,333.
- 1.0 grams of the leveling agent Union Carbide silicone L5202.

The mixture was coated onto a sheet of polyester film using a Bird applicator yielding a dry thickness of 250 microinches after drying in an oven at 105° C. for 3 minutes. The dried film was then immersed in water at 60° C. for 30 seconds, wiped dry, and allowed to stand at room ambient conditions for at least 30 minutes before use.

Image transfer was accomplished by first exposing the imaging film to ultraviolet light under an alphanumeric silver film positive master in a commercial vacuum frame printer (a Colight Model M-99) for 10 seconds then promptly removing the imaging film, plying it with the receiving film, and inserting the sandwich on the block and under the pad described above. After a prescribed period of time at a temperature of 60° C. the sandwich was removed, the plies separated, and the receiving film passed through a conventional thermal film hot roll developer, such as the Kalfile 360VS set at a temperature of 260° F.

A series of experiments were carried out with the above film in which the time (transfer time) on the block and under pressure was varied. The quality of the transferred image developed on the receiving film was evaluated on the basis of visual estimates in a microfilm viewer of (1) background density of the negative-appearing imagery and (2) the sharpness of the alphanumeric imagery. The following table summarizes the results.

| Transfer Time, sec. | Background Density | Image Sharpness |
|---|---|---|
| 20 | low | poor |
| 30 | medium | good |
| 50 | high | good |
| 70 | high | poor |

Increasing transfer time results in increased density probably because more gas diffuse from the imaging film to the receiving film. On the other hand, image sharpness initially increases to an optimum and then decreases as transfer time increases. At long transfer times probably lateral diffusion of gas occurs within the receiving film thus degrading sharpness of the transferred imagery.

EXAMPLE II

An imaging film similar to that of Example I was prepared except that the diazonium salt level was cut in half. Exposing as in Example I, a comparison of the effect of diazo loading on the two criteria of image quality was carried out with the following results. (Image transfer conditions were 60° C. for 30 seconds).

| Imaging Film | Receiving Film | Background Density | Image Sharpness |
|---|---|---|---|
| Example I (high diazo salt level) | Example I | medium | good |
| Example II (low diazo salt level) | Example I | low | poor |

The lower diazo salt loading provides an image inferior both in density and sharpness probably because the nitrogen concentration gradient is diminished in that imaging film.

EXAMPLE III

The nature of the vehicle used for the imagine film has a significant effect on the transfer process. Two imaging films were prepared and coated using the procedure in Example I and the following ingredients:

Eponol Vehicle Imaging Film

- 12.50 grams Shell Eponol 55B-40 solution (40% epoxy resin in methyl ethyl ketone, see U.S. Pat. No. 3,622,333, Example III.)
- 12.50 grams methyl cellosolve.
- 3.00 grams methyl ethyl ketone.
- 0.30 grams p-(2,5-diethoxymorpholino) benzene diazonium fluoborate.
- 0.10 grams Union Carbide silicone L5202.

Resorcinol Epoxide Imaging Film

- 25.00 grams of a 20% solids solution in methyl cellosolve of a polymer of diglycidyl ether of resorcinol with resorcinol of the type described in U.S. Pat. No. 3,622,333.
- 0.30 grams p-(2,5-diethoxymorpholino) benzene diazonium fluoborate.
- 0.10 grams Union Carbide silicone L5202.

Eponol and resorcinol epoxy polymers have permeabilities in the approximate ratio 10:1, respectively. Image transfer experiments carried out with these two imaging films and the receiving film of Example I gave the following results. (Exposure time = 10 seconds, transfer time and temperature = 60 seconds at 60° C. for both examples).

| Imaging Film | Receiving Film | Background Density | Image Sharpness |
|---|---|---|---|
| Eponol | Example I | medium | poor |
| Resorcinol Expoxide | Example I | high | good |

The imaging file having the lower permeability gives the highest background density in the receiving film and also the sharper imagery. Possibly this occurs because the nitrogen gas partitions between imaging and receiving films in such a way as to favor the film with the higher permeability. Thus, of two imaging films, the one with higher permeability would transfer less of its nitrogen to the receiving film.

EXAMPLE IV

The beneficial effect which nucleation as by the addition of a surfactant has on receiving film performance is illustrated by the following comparison. The performance of imaging and receiving films prepared as in Example I is contrasted with a similar pair except that the receiving film has 2% fluorocarbon surfactant FC-170 (3M Company designation) based on epoxy polymer added to the coating solution. The dried film is water treated as in Example I. The results of a comparison of image transfer performance are given below. Image transfer temperature was 60° C. and pressure was 67.5 psi.

| Imaging Film | Receiving Film | Transfer Time,sec. | Background Density | Image Sharpness |
|---|---|---|---|---|
| Ex. I | Example I | 20 | low | poor |
| Ex. I | Example I plus fluorocarbon | 15 | high | good |

The results show that the presence of the fluorocarbon surfactant in the receiving film results in high density and better sharpness in the transferred image even though the transfer time was somewhat less than that for the experiment without fluorocarbon.

EXAMPLE V

The transferred images of the preceding examples had occasional areas devoid of transferred imagery possibly due to pockets of gas accumulating during transfer and locally forcing the films apart. Pressure on the plied sample was increased to 360 lbs. or 640 psi. At this pressure satisfactory uniform contact was achieved and continuous transferred imagery resulted.

EXAMPLE VI

An imaging film was prepared from Dow Saran F-120 (copolymer of vinylidene chloride and acrylonitrile, see U.S. Pat. No. 3,032,414, Example I) by dissolving 5.00 grams of the resin in 30.00 grams of methyl ethyl ketone and then dissolving 0.3 grams of the diazonium salt in Example I. The solution was hand coated on polyester film to a dry thickness of 250 microinches. Drying conditions were 105° C. for 3 minutes. The receiving film was that of Example IV.

The imaging film was exposed for ten seconds under a high contrast alphanumeric positive image and then promptly plied with the receiving film. The image transfer was accomplished by squeezing the sandwich for 30 seconds in silicone rubber faced aluminum blocks held in the jaws of a drill press vice previously brought to a temperature of 50° C. by resting it on an adjustable temperature hot plate. A thermometer was inserted in a hole drilled in one aluminum block. The force on the sandwich was that resulting from firmly tightening the vice by hand. The transferred image density was high, the sharpness was good and no void areas were apparent.

I claim:

1. A method for transferring a photographic image comprising: exposing a vesicular film having a vehicle and light sensitive diazonium salt uniformly dispersed therein to actinic radiation to form a latent nitrogen gas image in said vehicle of a preselected master image; promptly directly physically contacting the vehicle of said vesicular film while it still contains said latent image with a sensitizer-free vesicular film vehicle having a nitrogen permeability not substantially lower than vehicle of said vesicular film; and applying sufficient heat and uniform pressure to cause an image-forming amount of said nitrogen gas to be transferred to said sensitizer-free vesicular film vehicle as a latent image; said heat being below the amount which causes vesiculation, subjecting said vesicular film vehicle after said gas is transferred to sufficient heat to develop a vesicular image within said vesicular film vehicle.

2. A method in accordance with claim 1 wherein the nitrogen permeability of said vesicular film is lower than the nitrogen permeability of said vesicular film vehicle.

3. A method in accordance with claim 1 wherein said vesicular film vehicle is large relative to the vesicular film image to be transferred, and wherein said heat and pressure are applied locally to transfer an image onto a relatively small portion of said vesicular film vehicle.

4. A method in accordance with claim 3 and including the step of heating said vesicular film vehicle locally at a temperature to develop a vesicular image in the area which has received the transfer of nitrogen gas.

5. A method in accordance with claim 1 wherein said sensitizer-free vesicular film vehicle is preliminarily nucleated to promote vesicle formation therein upon subsequent nitrogen gas transfer and heat development thereof.

6. A method in accordance with claim 5 wherein said vesicular film vehicle is nucleated by including therein a member selected from waxes and surfactants, or by subjecting the vesicular film vehicle to an aqueous fluid at an elevated temperature, or by immersion in an alkanol having up to 3 carbon atoms.

7. A method in accordance with claim 5 wherein said vesicular film is non-nucleated to inhibit vesicle formation therein prior to and during nitrogen gas transfer to said sensitizer-free vesicular film vehicle.

8. A method in accordance with claim 1 wherein said vesicular film vehicle and the vehicle employed in said vesicular film are both formed from a water insoluble thermoplastic synthetic organic polymer.

9. A method in accordance with claim 1 wherein image sharpness is improved by increasing the amount of diazonium salt in said vesicular film.

10. A method in accordance with claim 8 wherein the vehicle of said vesicular film and the vehicle of said sensitizer-free vesicular film vehicle are both formed from a film-forming thermoplastic linear poly(hydroxy ether) polymer of an epihalohydrin and a dihydric phenol.

* * * * *